US007354029B1

(12) United States Patent
Rutstein

(10) Patent No.: US 7,354,029 B1
(45) Date of Patent: Apr. 8, 2008

(54) APPARATUS AND METHOD FOR TREATING PROCESS FLUIDS

(76) Inventor: Alex Rutstein, 226 N. Prospect St., Oberlin, OH (US) 44074

( * ) Notice: Subject to any disclaimer, the term of this patent is extended or adjusted under 35 U.S.C. 154(b) by 0 days.

(21) Appl. No.: 11/138,326

(22) Filed: May 27, 2005

Related U.S. Application Data

(60) Provisional application No. 60/575,164, filed on May 28, 2004.

(51) Int. Cl.
*B01F 3/04* (2006.01)

(52) U.S. Cl. ..... 261/76; 261/78.2; 239/DIG. 7

(58) Field of Classification Search ..... 261/76, 261/78.1, 78.2, 115, DIG. 12; 239/DIG. 7
See application file for complete search history.

(56) References Cited

U.S. PATENT DOCUMENTS 141,361 A * 7/1873 Korting ..... 261/76
1,055,210 A * 3/1913 Morison ..... 417/167
1,372,740 A * 3/1921 Chandler ..... 261/72.1
2,905,543 A * 9/1959 Schreter et al. ..... 48/184
3,665,949 A * 5/1972 Rivard ..... 137/806
3,685,614 A * 8/1972 Coanda et al. ..... 181/256
3,817,685 A * 6/1974 Joannes ..... 431/116
3,972,523 A * 8/1976 Brandes ..... 271/183
4,332,529 A * 6/1982 Alperin ..... 417/54
4,369,549 A * 1/1983 Sanders ..... 19/145.7
4,448,354 A * 5/1984 Reznick et al. ..... 239/265.17
6,604,694 B1 * 8/2003 Kordas et al. ..... 239/398

* cited by examiner

*Primary Examiner*—Scott Bushey
(74) *Attorney, Agent, or Firm*—Terry M Gernstein

(57) ABSTRACT

A process fluid treating apparatus includes an ejector assembly fluidically connected to a process fluid supply assembly. A Coanda airfoil is located in the ejector assembly. Primary fluid is injected into the ejector duct to form a Coanda layer. A process fluid, or part of it, flows toward the ejector assembly through the process fluid assembly, which gradually turns that process fluid towards fluid treating channel formed adjacent to the Coanda layer. Shear and other forces and pressure gradients associated with the Coanda layer serve to pump or assist in pumping the process fluid from the source and to operate on the process fluid to atomize it, to pulverize, or de-agglomerize solid particles entrained in the process fluid, to produce high mass flow rate of the process fluid and to provide aerosol down to micron and sub micron mean droplet diameter size.

12 Claims, 9 Drawing Sheets

APPARATUS AND METHOD FOR TREATING PROCESS FLUIDS

CROSS REFERENCE TO RELATED APPLICATIONS

The present application claims priority of Provisional Application Ser. No. 60/575,164 filed by the present inventor on May 28, 2004. The disclosure of the just-mentioned Provisional Application is fully incorporated herein by reference.

TECHNICAL FIELD OF THE INVENTION

The present invention relates to the general art of fluid handling and fluid treating, and to the particular field of means and methods for pumping, atomizing fluids, pulverizing, or de-agglomerizing solids in mixtures of fluids and/or mixtures of fluids and solids.

BACKGROUND OF THE INVENTION

Many industrial processes require aerosolizing of fluids, or treating of a mixture of fluids and/or fluids and solids. Treatment of a fluid, a mixture of fluids, or a mixture of fluids and solids can be in the form of atomizing the liquid and pulverizing or de-agglomerizing the solids carried by the fluid. Current means and methods for effecting such treatment include, among others, atomizing, mist producing, and pulverizing nozzles and as well as vibration machinery. The art includes many examples of equipment embodying these mechanisms and processes. While some of the known equipment is effective, many forms of such equipment have high power requirements. In particular, atomizing, or spraying nozzles require high motive gas pressure as well as high (typically 4 to 6) gas to liquid mass flow rate ratio while producing relatively large mean droplet sizes. Such nozzles production rate reduces drastically when small, sub micron to micron size droplets are required as well as posses other drawbacks. Some related equipment, and especially gas compressors may have high initial and maintenance cost and the like. Cost problems may be exacerbated if the required gas pressure is high. If the rotating equipment is large and/or bulky, the cost factors can be even further worsened by large space requirements.

Furthermore, many industrial processes require pumping the fluids, or mixtures of fluids and solids, from respective sources to the processing apparatus. Negative suction head is often used for fluids or fluids and solids mixtures transportation. Current means for forming negative suction heads include vacuum pumps and flow ejectors. Vacuum pumps consume a lot of energy and are known to be heavy, bulky and expensive to operate. Flow ejectors could be relatively small and inexpensive but are capable of providing only small suction head at moderate (≦30 psig) primary fluid pressure. Therefore, there is a need for an efficient and reliable means and method for treating fluids, or solids in mixtures of fluids and solids, and for a means and method for reliably and efficiently operating on such mixtures or components of such mixtures.

OBJECTS OF THE INVENTION

The main object of the present invention is to provide an efficient, reliable and inexpensive means and method for atomizing fluids.

Another object of the present invention is to provide an efficient, reliable and inexpensive means and method for producing high mass flow rate of aerosols.

Another object of the present invention is to provide an efficient, reliable, and inexpensive means and method for producing high mass flow rate of aerosol having micron and submicron mean droplet diameter sizes.

Another object of the present invention is to provide an efficient and reliable means and method for exposing solid particles or solid components in a mixture of fluids and solids to high shear forces.

Another object of the present invention is to expose fluids or mixtures of fluids to high shear forces.

Another object of the present invention is to provide a high suction head for the purposes of transporting fluids or solids, or mixtures of fluids, or mixtures of fluids and solids from a source or sources.

SUMMARY OF THE INVENTION

These, and other, objects are achieved by combining a Coanda ejector with a special fluid handling assembly so multiple uses of the Coanda effect are made whereby the overall apparatus efficient, simple and reliable. Specifically, the Coanda ejector is used to simultaneously pump or assist in pumping of a process fluid, a fluid mixture, or a fluid mixed with solids from a source or sources through the special process fluid supply assembly into an ejector duct, and to operate on at least one of the fluid components. Specifically, the special process fluid supply assembly embodying the present invention is combined with a Coanda ejector for utilizing the Coanda effect at the ejector inlet section thereof. The process fluid supply assembly directs fluid to be treated toward the annular fluid treatment channel formed by Coanda airfoil and a truncated cone-like part of the process fluid supply assembly, inside of which the Coanda layer not only operates on a fluid, or solid in the mixture of fluids and/or fluids and solids, but also serves to transport the fluid from a source or sources into the ejector assembly and operates on that fluid by exposing it or the solid particles it carries to the forces associated with the Coanda layer.

The means and method embodying the present invention utilizes a Coanda effect manifesting itself in the inlet region of a Coanda ejector. The fluid layer, known as the Coanda layer is formed by a primary fluid injected through an annular nozzle at a high, typically sonic velocity into the ejector duct. The Coanda layer adheres to a Coanda airfoil surface according to the Coanda effect, in particular, between the annular Coanda nozzle exit and the ejector throat plane. The ejector based on the Coanda effect will be referred to as a Coanda ejector.

The Coanda ejector is fluidically connected to the outlet of a process fluid supply assembly through which a part or all of the secondary fluid to be operated on, is flowing. If only a part of the secondary fluid, called process fluid, is passing through the process fluid supply assembly, the rest of the secondary fluid, called induced fluid, is induced, typically, from the atmosphere, into the remaining area of the ejector duct, unoccupied by the process fluid supply assembly elements.

The combination of the Coanda ejector and the process fluid supply assembly utilizes the forces and pressure gradients associated with the Coanda effect in the flow ejector to achieve several simultaneous results: transporting or assisting in transportation of the process fluid from a source or sources to the Coanda ejector; operating on the process fluid as it passes through the above annular fluid treatment channel and/or operating on some or all of the materials carried by the process fluid.

Process fluid is brought into the ejector duct partly under the influence of the pressure gradient established in the inlet section of the Coanda ejector and partly, when necessary, by a pump application. The process fluid is smoothly guided by the process fluid supply assembly into the annular fluid treating channel whereat the Coanda shearing and other forces as well as pressure gradients operate on the process fluid in an efficient, sustainable, and reliable manner.

BRIEF DESCRIPTION OF THE DRAWING FIGURES

DETAILED DESCRIPTION OF THE PREFERRED EMBODIMENT OF THE INVENTION

Figure 1:
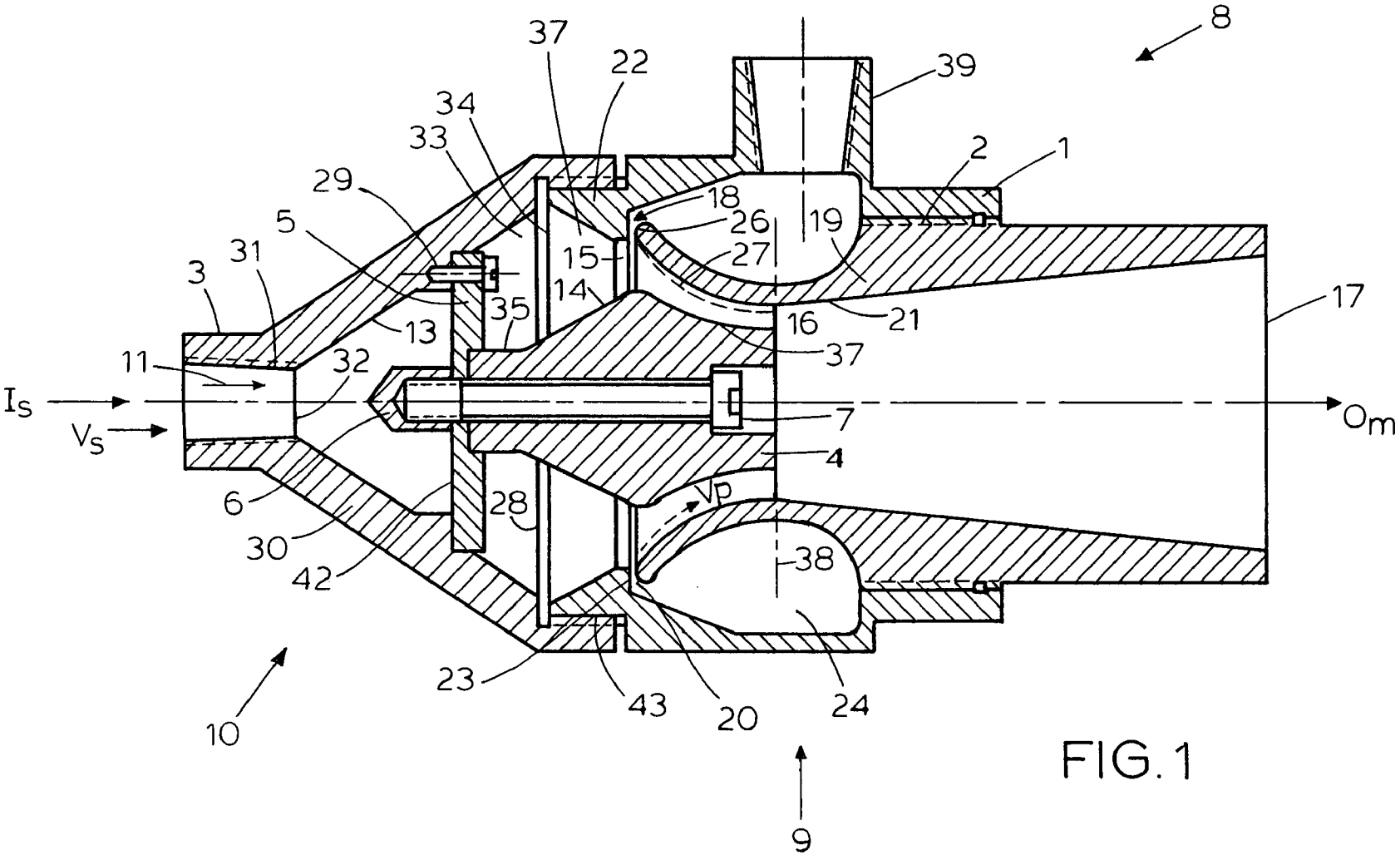
FIG. 1 is a side elevational view, partially cut away, embodying the present invention as including a Coanda ejector fluidically connected to a special process fluid supply assembly.
Figure 2B:
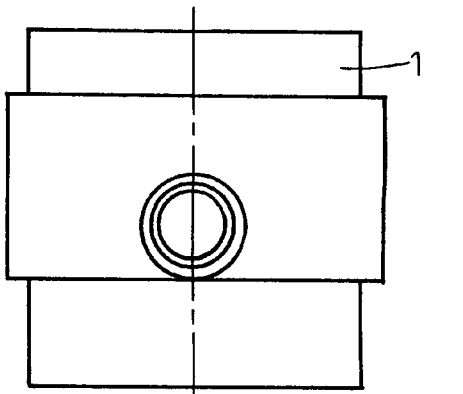
FIG. 2B is a top plan view of the Coanda ejector housing.
Figure 2C:
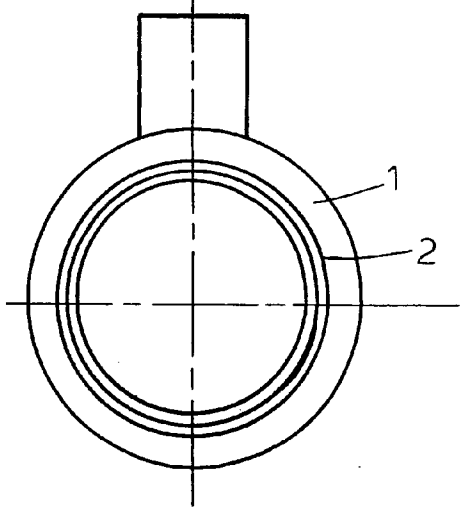
FIG. 2C is a downstream end elevational view of the Coanda ejector housing.
Figure 2A:
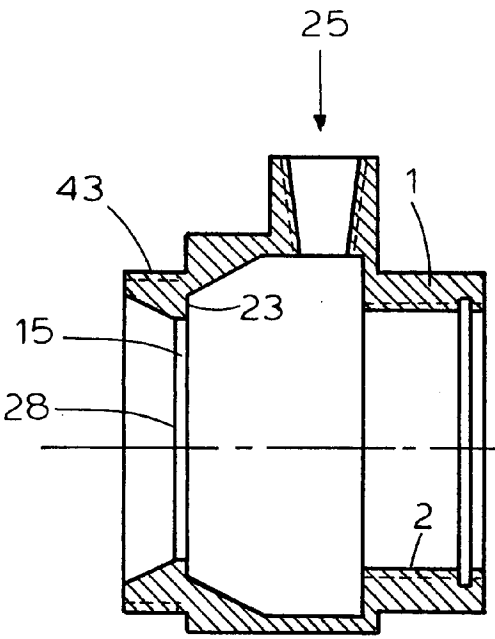
FIG. 2A is a side elevational view of the Coanda ejector housing.

As shown in FIG. 1, a process fluid treating apparatus 8 embodying the present invention includes a Coanda ejector assembly 9 fluidically connected to a process fluid supply assembly 10, with a process fluid, a mixture of process fluids, and/or a mixture of process fluids and solids 11 flowing into the inlet port 12 of the process fluid supply assembly 10 in direction $I_s$, passing through windows provided in the support plate 5 of an insert 4, and being turned by the inner walls 13 of the process fluid supply assembly 10 and the ascending outer walls 14 of the specially profiled insert 4 toward the annular entrance 15 into the process treating channel 16, with a mixture flowing out of an exit 17 of the Coanda ejector assembly in direction $\mathbf{0}_m$. As used hereinabove, the term "mixture" means the primary fluid 18 and process fluid 11. The fluid exiting the ejector assembly has typically near-ambient pressure. It is noted that the passageway 16 enables ejector assembly 9 to provide steady and controllable operating conditions. Without such passageway and the walls associated therewith, such steady and controllable operating conditions will not be practical.

The ejector assembly 9 includes a housing 1, which, along with Coanda airfoil element 19, forms an annular nozzle 20. The inlet section of the airfoil element 19 converges in the direction of fluid flow to the ejector throat location 38, and the outlet section of the airfoil element 19 diverges in the direction of fluid flow from the ejector throat location to the point of connection with the fluid treating apparatus exit 17. Coanda ejector 9 housing 1 includes an entrance section 22, which has a plane 23. Coanda ejector 9 is fluidically connected to a primary fluid supply nozzle 20. The primary fluid supply nozzle 39 is fluidically connected to an ejector annular chamber 24, which, in turn, is fluidically connected to a source of high-pressure primary fluid (not shown). The high pressure primary fluid flows into the ejector chamber 24 in direction 25.

The Coanda annular nozzle 20 is formed by the inlet tip 26 of the Coanda airfoil element 19 and the plane 23 of the ejector Inlet section 22. The high pressure primary fluid flows from the ejector chamber 24 in direction 18, and, as jet 27, out of the annular nozzle 20 with a velocity $V_p$. As discussed above, primary fluid issuing from a nozzle, such as nozzle 20, forms a Coanda layer 27, flowing adjacent to the Coanda airfoil element 19 inner wall 21. Based on the principles of the Coanda effect, layer 27 creates shear forces and pressure gradients. In the process fluid treating apparatus 8, the shear forces and pressure gradients associated with the Coanda layer are used to achieve the simultaneous goals of pumping, assisting in pumping, or transporting the process fluid or fluid/solid mixture from a source or sources to and through the process fluid supply assembly, and operating on the process fluids and/or solids. The pressure gradients associated with the Coanda layer develop a suction head that allows the drawing or assistance in the drawing of process fluid into the process fluid supply assembly 10, and thus reduces the amount of energy needed to transport the process fluid from the source or sources. For the sake of convenience, the Coanda airfoil wall surface adjacent to the Coanda layer 27 will be referred to as the Coanda airfoil 21. In the preferred embodiment of the invention, FIG. 1, the nozzle 20 extends 360°. As will be discussed below, the process fluid can also be directed to flow exclusively into a specific sector or sectors of the ejector duct.

Figure 4B:
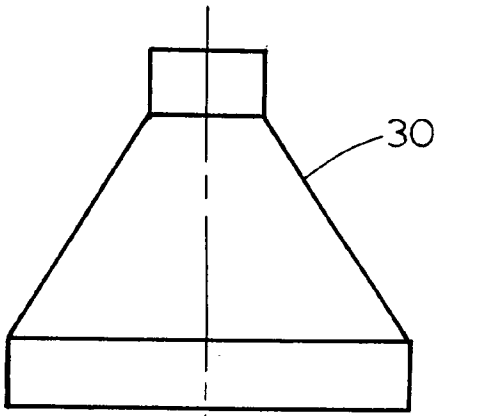
FIG. 4B is a top plan view of the process fluid supply assembly housing.
Figure 4C:
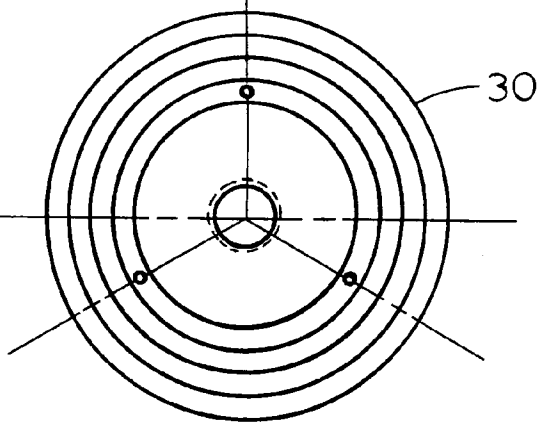
FIG. 4C is a downstream end elevational view of the process fluid supply assembly housing.
Figure 4A:
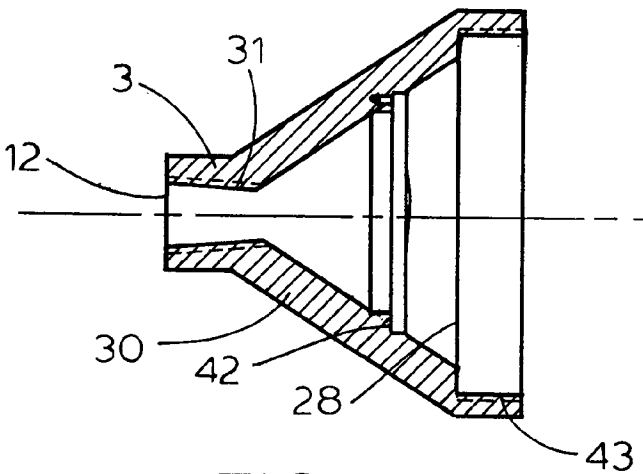
FIG. 4A is a side elevational view of the process fluid supply assembly housing.

As is best shown in FIGS. 1, and 4A, the process fluid supply assembly 10 includes a material supply nozzle 3, with its inlet port 12 fluidically connected to a source of process fluid, and an outlet port 28 fluidically connected to the ejector housing 1. As is conventional in the art, the term "fluid" is intended herein to include both liquid and gas. The process fluid includes a fluid, and/or a mixture of fluids and/or a mixture of fluids and solids, with the solids being in the form of particles, such as fibers or powders, or both, and it flows with a flow velocity of $V_S$, with $V_s << V_p$. The process fluid can, for example, include mixtures of fluids having different densities, fluids having liquid globules entrained therein, or fluids having solids, such as particles, fibers, and the like, entrained therein. The process fluid is directed by the process fluid supply assembly into contact with the Coanda layer 27 to be operated on by the forces and pressure gradients associated with that Coanda layer. The process fluid flows under the influence of the pressure gradient associated with the Coanda effect established in the entrance section of ejector assembly 9, or under the influence of pumps (not shown), or both. The Coanda effect-generated pressure gradient is discussed in art such as U.S. Pat. No. 4,448,354, the disclosure of which is incorporated herein by reference, and will not be discussed herein.

As mentioned above, process fluid supply assembly 10 directs the process fluid towards the Coanda surface and the Coanda layer. The process fluid supply assembly includes elements that affect the direction of the process fluid flow, and these elements will be discussed below.

As is best shown in FIGS. 1, 4A, 5A, and 6A, the process fluid supply assembly's housing 30 includes an inlet nozzle 3 equipped with a female thread 31 for the fluid supply hose or pipe ending with a matching male connector (not shown). The nozzle 3 outlet 32 is oriented perpendicularly to the axis of the nozzle. The inner walls 13 of the process fluid supply assembly housing 30 angle upwardly from the edges of the nozzle 3 outlet 32 toward the three windows provided in the support plate 5, best shown in FIG. 6C. Having passed through the windows, the process fluid is directed by the annular channel 33, formed by the inner walls 13 of the process fluid supply assembly housing 30 on the outer side and the outer cylindrical walls of the upstream section 35 of the insert 4 on the inner side, toward the housing 30 planar exit 28, and further toward the planar inlet 34 into the converging annular channel 36, formed by the inner walls 13 of the process fluid supply assembly housing 30 on the outer side and inner lateral conical walls 14 of the insert 4 upstream section on the inner side. Further downstream, the process fluid passes through the annular channel 37, formed by the cylindrical bore in the ejector housing entrance section 22, toward the annular planar entrance 15 into the process fluid treating channel 16. Inside the channel 16, the process fluid is continually subjected to the shear and other forces and pressure gradients associated with the Coanda layer 27 to pump or assist in pumping of the process fluid from the source or sources and to operate on the process fluid to atomize it, as well as to pulverize, or deagglomerize solid particles entrained in the process fluid. The rest of the Coanda airfoil, downstream from the ejector throat location 38, is used to improve the mixing of solid particles with the liquid component of the process fluid, to reduce the exit flow velocity, and to bring the pressure of the process fluid and primary gas mixture at the ejector exit 17 to a level close to atmospheric.

Figure 5B:
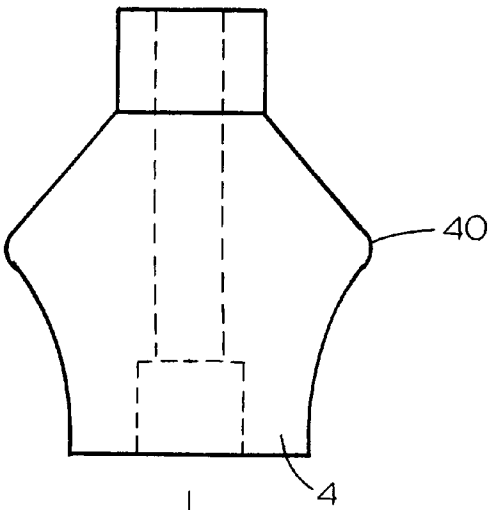
FIG. 5B is a top plan view of the process fluid flow direction component.
Figure 5C:
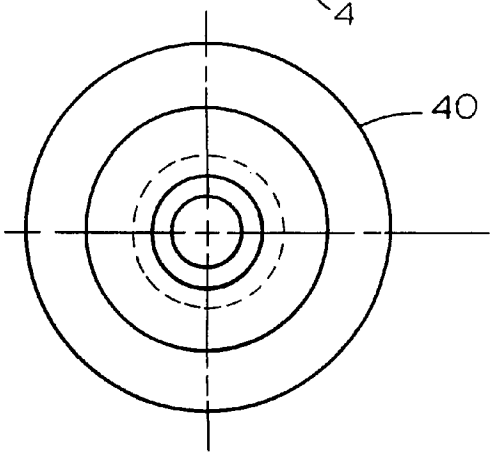
FIG. 5C is a downstream end elevational view of the process fluid flow direction component.
Figure 5A:
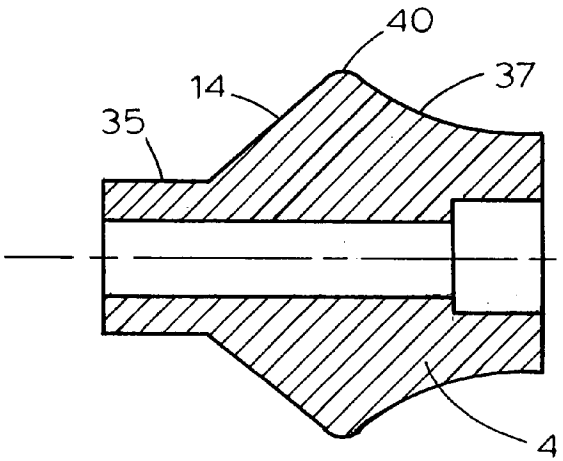
FIG. 5A is a side elevational view of the process fluid flow direction component.
Figures 6A, 6B, 6C:
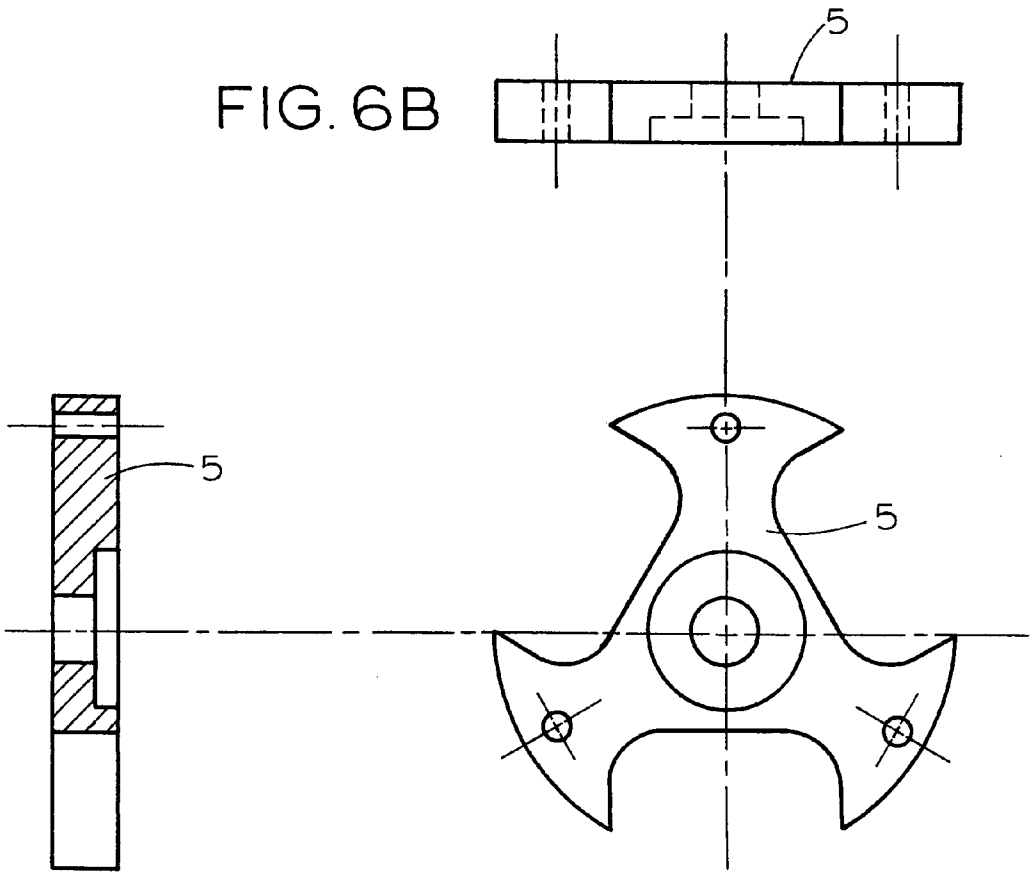
FIG. 6A is a side elevational view of the process fluid flow direction component support plate.
FIG. 6B is a side view of the process fluid flow direction support plate.
FIG. 6C is a top plan view of the process fluid flow direction support plate.
Figure 7B:
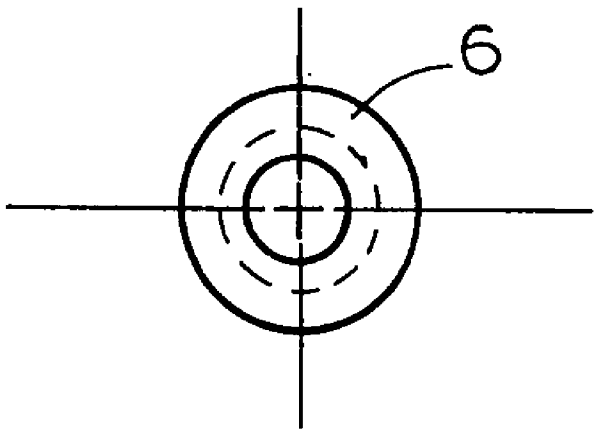
FIG. 7B is a downstream end elevational view of the special nut for securing an assembly of the process fluid flow direction component and its support plate.
Figure 7A:
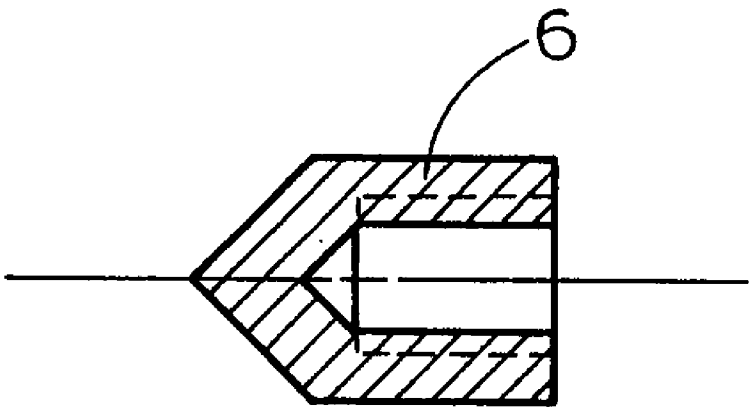
FIG. 7A is a side elevational view of the special nut for securing an assembly of the process fluid flow direction component and its support plate.

As shown in FIGS. 1 and 5A, the process fluid flow direction component 4 includes downstream and upstream parts. For the sake of convenience, the fluid flow direction component 4 will be referred to as insert 4. The insert 4 upstream part includes a cylindrical section 35 mating with the support plate 6A. The insert 4 further includes a first lateral section 14 extending from the edges of the cylindrical section 35 to the downstream end of the rounded off lateral section 40. The upstream end of the section 40 turns smoothly into a second lateral surface 41. As shown in FIG. 5A, surface 41 could be, for instance, curved so as to become equidistant from Coanda airfoil 21. Different applications of the present invention may require different configurations of the process fluid treatment channel 16 formed by Coanda airfoil 21 on the outer side and lateral semi-conical walls 14 of the insert 4 on the inner side; and thus, different configurations of the surface 41. For example the surface 41 could be a lateral conical, or a lateral curved. A lateral curved surface 41 could, in conjunction with a Coanda airfoil, form a diverging or a converging channel 16, and so on.

As shown in FIG. 1, the insert 4, the insert support plate 6A, and the special nut 6 are fastened together by a fastener 7 so that all of them become coaxial with the process fluid supply assembly 10 and Coanda ejector 9.

As shown in FIGS. 1, 4A, 4C, 6A, 6B, and 6C, the insert support plate is fastened to the process fluid supply assembly planar vertical wall 42 with the fasteners 29.

As shown in FIGS. 1 and 4A, the process fluid supply assembly housing 30 is fastened to the Coanda ejector housing 1 with a thread 43.

Figure 3B:
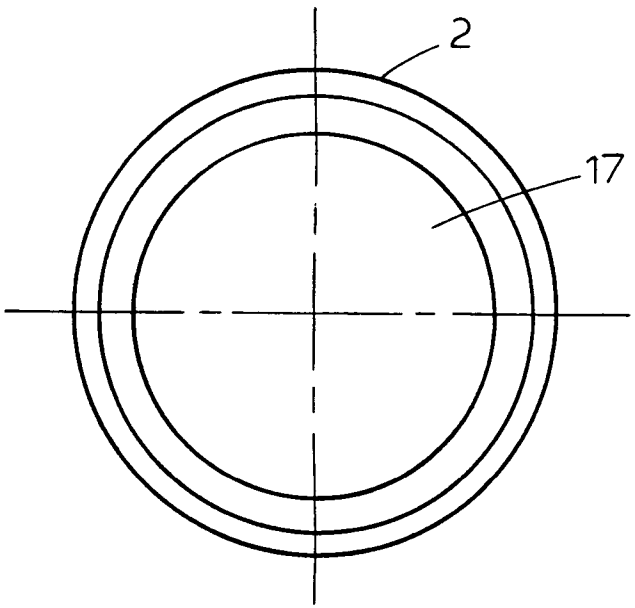
FIG. 3B is a downstream end elevational view of the Coanda airfoil component.
Figure 3A:
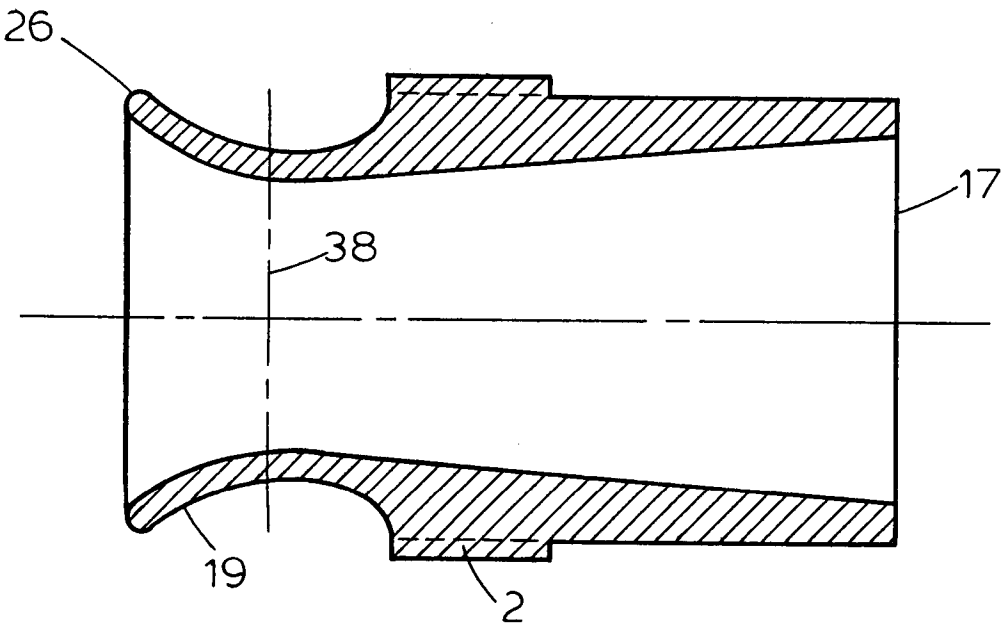
FIG. 3A is a side elevational view of the Coanda airfoil component.

As shown in FIGS. 1 and 3A, the Coanda airfoil component 19 is fastened to Coanda ejector housing 1 using a thread 2. Thread 2 could be used for Coanda nozzle 20 width adjustment as may be required to increase or reduce the primary fluid flow.

Other forms of the invention can differ from the above in a variety of ways while immutably utilizing the same concept: the process fluid is brought in contact with the Coanda layer which flows along Coanda airfoil walls, to be subjected to forces and pressure gradients associated with the Coanda layer.

One form of this invention can utilize Coanda layer forces operating on the process fluid using only a part of the Coanda airfoil walls extending for other than 360° about the axis of the ejector assembly.

In essence, any part of the Coanda airfoil walls extending from $A_c$ degrees about the axis of the ejector assembly, where $0<A_c<360°$, or multiple parts of the Coanda airfoil can be used for the operating on the process fluid. The part of Coanda airfoil walls not used for the process fluid treatment, is typically utilized for inducing the ambient air into the Coanda ejector duct. The ambient air is used for the process fluid/primary fluid mixture dilution, better mixing, and acceleration.

Figure 8:
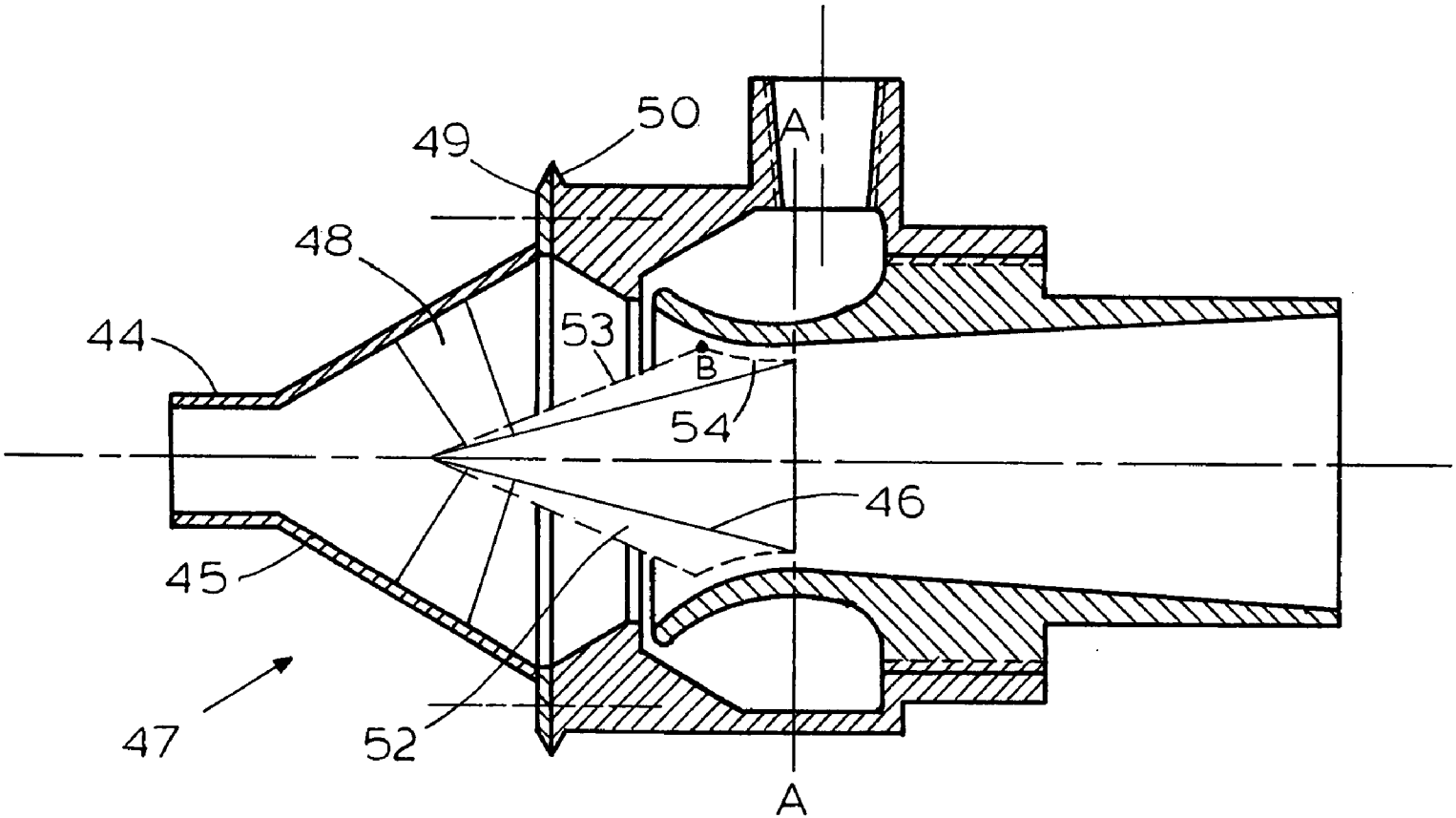
FIG. 8 is a side elevational view, partly cut away, of a Coanda ejector based apparatus for treating process fluids.
Figure 9D:
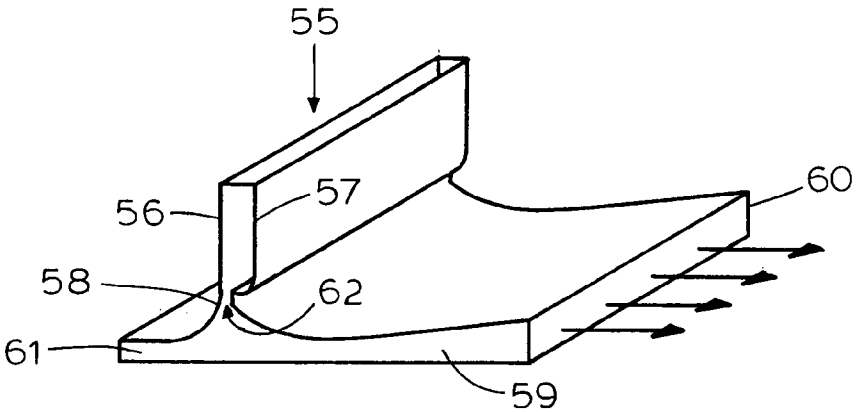
FIG. 9D is a 3D representation of a Coanda effect based apparatus for treating process fluids.
Figure 9C:
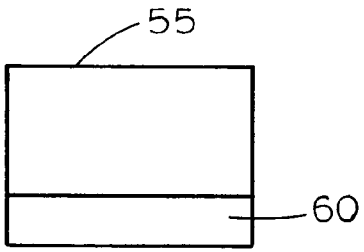
FIG. 9C is a top plan view of a Coanda effect based apparatus for treating process fluids.
Figure 9A:
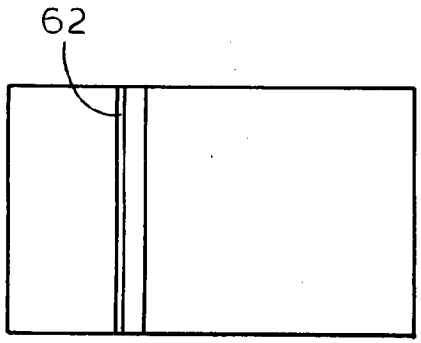
FIG. 9A is a top plan view of the Coanda effect based apparatus for treating process fluids.
Figure 9B:
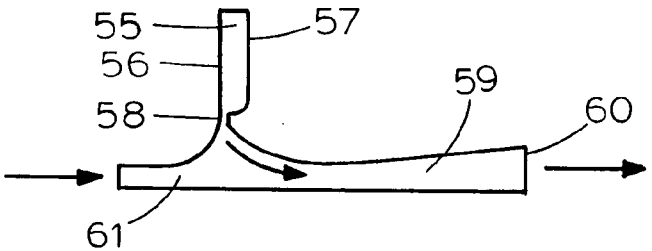
FIG. 9B is a side view of the Coanda effect based apparatus for treating process fluids.

FIG. 8 shows another form of this invention which includes three main parts: process fluid supply pipe 44, outer cone 45, and inner cone 46, forming a process fluid supply assembly 47, Ribs 48 connect the inner cone 46 to the outer cone 45. Flange 49 is used to fasten the process fluid supply assembly to the Coanda ejector's inlet plane 50. Coanda airfoil is represented by number 51, with line AA indicating ejector throat plane.

As follows from FIG. 8, the passageway for the process fluid is formed by the Coanda airfoil on its outer side and a conic lateral surface of the inner core 46 on its inner side. The cross section of this passageway is monotonously reduced until reaching its throat, flush with the ejector throat. In this particular case, the major part of the Coanda airfoil is used to create high suction head for transporting the process fluid from a source or sources. However, the residence time of the process fluid within the area of the close proximity to the shear forces operation in this case is small.

Where a need does exist in increasing the residence time, instead of the inner cone 46, a component similar to the insert 4, FIG. 1, is used. Just like the insert 4, component 52, the contour of which is shown by dotted lines, includes two lateral surfaces, 53 and 54. The position of the apex B can vary depending on the two factors: a desired suction head, and a desired residence time of the process fluid in close proximity to the Coanda layer shear and other forces. When smaller suction head is needed, point B is moved upstream, and vice versa.

FIG. 9 shows still another form of the invention, a different Coanda effect based process fluid treating apparatus. As follows from FIG. 9, the primary gas is coming through a vertical duct 55, whose walls 56 and 57 form a Coanda nozzle 58. The Coanda nozzle cross section in this case is shown in FIG. 9A as a long and narrow rectangle 62. The pressurized primary fluid accelerates at the Coanda nozzle and forms thereafter a Coanda layer which flows adjacent to the upper wall of the exit duct 59 towards the exit 60 of the process fluid treatment apparatus.

The pressure differential associated with Coanda layer provides for process fluid transportation to the process fluid treatment apparatus inlet duct 61. Through the duct 61, the process fluid moves towards and through the duct 59 where shear and other forces associated with the Coanda layer operate on it. This form of the present invention could be used, for example, to produce wide swaths of aerosol required to treat large surfaces. It is understood that while certain forms of the present invention have been illustrated and described herein, it is not to be limited to the specific forms or arrangements of parts described and shown.

The invention claimed is:

1. A process fluid treating apparatus comprising:

A) a process fluid supply assembly, which includes (1) an inlet section fluidically connected to a source of process fluid, (2) an outlet section fluidically connected to the inlet section, and (3) a longitudinal axis which extends between the inlet section of the process fluid supply assembly and the outlet section of the process fluid supply assembly;

B) a body element mounted on said process fluid assembly to be in line with the longitudinal axis of the process fluid supply assembly and to be contacted by process fluid flowing through the process fluid supply assembly and including a shaped exit section, the exit section of the body element having a curvature which is concave in shape;

C) a Coanda airfoil assembly fluidically connected to said process fluid assembly and including (1) a flow section located adjacent to the shaped exit section of said body element, the flow section of said Coanda airfoil assembly being convex in shape and having a curvature that matches the curvature of the exit section of the body element and being spaced apart from the shaped exit section of said body element to define a curved passageway through which process fluid flows, (2) said Coanda airfoil assembly being fluidically connected to a source of primary fluid, (3) a primary fluid outlet port defined in the flow section of said Coanda airfoil assembly and fluidically connected to the source of primary fluid so that primary fluid is injected into the passageway adjacent to said Coanda airfoil assembly, (4) so as to form a Coanda layer of primary fluid flowing adjacent to Coanda airfoil assembly adjacent to the exit section of said body element, the Coanda layer having shear forces and pressure gradients associated therewith;

D) the outlet section of said process fluid supply assembly being located and oriented with respect to the Coanda layer to direct process fluid into the passageway toward and into contact with the Coanda layer of primary fluid in a direction and manner so that the shear forces and pressure gradients associated with the Coanda layer are applied to the process fluid flowing in contact with the Coanda layer so that the shear forces and pressure gradients of the Coanda layer of primary fluid act on the process fluid to pump the process fluid from the process fluid supply assembly inlet section to the process fluid supply assembly outlet section and to turn the process fluid into small components.

2. The process fluid treating apparatus defined in claim 1 wherein said body element is conically shaped.

3. The process fluid treating apparatus defined in claim 1 wherein the shaped exit section of said body element converges in the direction of process fluid flow.

4. The process fluid treating apparatus defined in claim 1 wherein said process fluid includes solid particles entrained therein.

5. The process fluid treating apparatus defined in claim 1 wherein said process fluid includes liquid particles entrained therein.

6. The process fluid treating apparatus defined in claim 1 wherein said primary fluid has a flow velocity and said process fluid has a flow velocity, with said primary fluid flow velocity exceeding the process fluid flow velocity.

7. The process fluid supply assembly defined in claim 2 wherein said conically shaped body element includes an apex angle which is in the range of 12° and 45°.

8. The process fluid supply assembly defined in claim 1 wherein said Coanda airfoil assembly is annular and extends for 360° about an axis of a process fluid treating apparatus centerline.

9. The process fluid supply assembly defined in claim 1 wherein the outlet section of said process fluid supply assembly is oriented with respect to the passageway to direct process fluid to flow essentially parallel to the Coanda layer of primary fluid flowing in the passageway.

10. A process fluid treating apparatus comprising:

A) an ejector assembly, which includes (1) an ejector inlet section having an inlet port on one end thereof, (2) an ejector throat on a second end of said inlet section, and (3) an ejector outlet section having one end thereof fluidically connected to said throat and having an exit port on a second end thereof;

B) a Coanda airfoil element fluidically connected to said ejector assembly so as to form a Coanda nozzle through which primary fluid is injected into the ejector duct, primary fluid being injected into the ejector duct forming a Coanda layer of primary fluid flowing adjacent to Coanda airfoil walls, said Coanda airfoil element including (1) a primary fluid supply nozzle fluidically connected to a source of the primary fluid, (2) a Coanda airfoil fluidically connected to the primary fluid supply nozzle and fluidically connected to said ejector assembly, and (3) the Coanda layer of primary fluid being formed on the Coanda airfoil; and C) a process fluid supply assembly fluidically connected to said ejector assembly for supplying process fluid to said ejector assembly including (1) an inlet fluidically connected to a source of process fluid, (2) an outlet fluidically connected to said ejector assembly inlet section, the outlet being located to direct process fluid toward the Coanda layer and into contact with said Coanda layer of primary fluid so that forces associated with the Coanda layer are transferred to the process fluid flowing in contact with the Coanda layer and including an inner cone mounted on a divider plate of said process fluid supply assembly outlet and having an apex located upstream of said inner cone base and upstream of said ejector throat, with forces associated with the Coanda layer of primary fluid acting on the process fluid to pump the process fluid from the ejector inlet section to the ejector outlet section and to separate components of the process fluid from each other.

11. A process fluid treating apparatus comprising:

A) an ejector assembly, which includes (1) an ejector inlet section having an inlet port on one end thereof, (2) an ejector throat on a second end of said inlet section, and (3) an ejector outlet section having one end thereof fluidically connected to said throat and having an exit port on a second end thereof;

B) a Coanda airfoil element fluidically connected to said ejector assembly to be in line with the longitudinal axis of the ejector assembly and having a section that is curved to be convex so as to form a Coanda nozzle through which primary fluid is injected into the ejector duct, primary fluid being injected into the ejector duct forming a Coanda layer of primary fluid flowing adjacent to Coanda airfoil walls, said Coanda airfoil element including (1) a primary fluid supply nozzle fluidically connected to a source of the primary fluid, and (2) a Coanda airfoil fluidically connected to the primary fluid supply nozzle and fluidically connected to said ejector assembly;

C) a Coanda layer of primary fluid located adjacent to the Coanda airfoil, the Coanda layer of primary fluid developing shear forces and pressure gradients associated with the Coanda layer; and D) a process fluid supply assembly fluidically connected to said ejector assembly for supplying process fluid to said ejector assembly, the process fluid supply assembly including (1) an inlet fluidically connected to a source of process fluid, (2) an outlet fluidically connected to said ejector assembly inlet section, the outlet being located in line with the longitudinal axis of the ejector assembly to direct process fluid toward the Coanda layer and into contact with the Coanda layer of primary fluid so that forces associated with the Coanda layer act on the process fluid flowing in contact with the Coanda layer, (3) the process fluid supply assembly further including (a) a divider plate connected to said process fluid supply assembly outlet, (b) an inner cone mounted on the divider plate and having a base and an apex which is located upstream of the inner cone base and upstream of the throat of the ejector assembly, the inner cone being located so as to create a passageway for the process fluid where it is being affected by the shear forces and pressure gradients of the Coanda layer, (c) the process fluid being directed into contact with the Coanda layer in a manner which permits the shear forces and the pressure gradients of the Coanda layer of primary fluid to act on the process fluid to pump the process fluid from the ejector inlet section to the ejector outlet section and to separate components of the process fluid from each other.

12. A process fluid treating apparatus comprising:

A) a process fluid supply assembly, which includes (1) an inlet section fluidically connected to a source of process fluid, (2) an outlet section, (3) a divider plate, and (4) an inner cone mounted on the divider plate of said process fluid supply assembly to be located in the outlet section of the process fluid supply assembly, the inner cone having a base and an apex located upstream of the base of the inner cone and upstream of the ejector throat;

B) an ejector assembly, which includes (1) an ejector inlet section having an inlet port on one end thereof fluidically connected to the outlet section of the process fluid supply assembly, (2) an ejector throat on a second end of said inlet section, and (3) an ejector outlet section having one end thereof fluidically connected to the throat of the ejector assembly and having an exit port on a second end thereof;

C) a body element mounted on said process fluid supply assembly and including a shaped exit section;

D) a Coanda airfoil assembly fluidically connected to said process fluid assembly and including (1) a flow section located adjacent to the shaped exit section of said body element, the flow section of said Coanda airfoil assembly being spaced apart from the shaped exit section of said body element to define a passageway through which process fluid flows, (2) said Coanda airfoil assembly being fluidically connected to a source of primary fluid, (3) a primary fluid outlet port defined in the flow section of said Coanda airfoil assembly and fluidically connected to the source of primary fluid so that primary fluid is injected into the passageway adjacent to said Coanda airfoil assembly so as to form a Coanda layer of primary fluid flowing adjacent to Coanda airfoil assembly between said Coanda assembly and to the exit section of said body element;

E) the outlet section of said process fluid supply assembly being located to direct process fluid toward the Coanda layer into the passageway and into contact with said Coanda layer of primary fluid so that forces associated with the Coanda layer are transferred to the process fluid flowing in contact with the Coanda layer with forces associated with the Coanda layer of primary fluid acting on the process fluid to pump the process fluid from the process fluid supply assembly inlet section to the process fluid supply assembly outlet section and to separate the process fluid into small components.

* * * * *